United States Patent [19]

Jasinski

[11] 4,433,214

[45] Feb. 21, 1984

[54] ACOUSTICAL TRANSDUCER WITH A SLOTTED PISTON SUSPENSION

[75] Inventor: Leon Jasinski, Fort Lauderdale, Fla.

[73] Assignee: Motorola, Inc., Schaumburg, Ill.

[21] Appl. No.: 334,391

[22] Filed: Dec. 24, 1981

[51] Int. Cl.[3] ..... H04R 9/00; H04R 9/04

[52] U.S. Cl. ..... 179/115.5 ES; 179/115.5 R; 179/181 R; 181/172

[58] Field of Search ..... 181/171, 172; 179/115.5 R, 181 R, 115.5 ES; 29/592; 219/121 PC, 121 PD, 121 EH, 121 EJ

[56] References Cited

U.S. PATENT DOCUMENTS

| | | | |
|---|---|---|---|
| 1,514,511 | 11/1924 | Fischer | 181/171 |
| 1,621,670 | 4/1927 | Jokel | 181/171 |
| 1,722,020 | 7/1929 | Smythe | 181/171 |
| 1,759,725 | 5/1930 | Young et al. | 181/171 |
| 1,821,933 | 9/1931 | Darnell | 181/171 |
| 2,439,665 | 4/1948 | Marquis | 181/172 |
| 2,439,666 | 4/1948 | Marquis | 181/172 |
| 2,993,558 | 7/1961 | Reisz | 181/32 |
| 3,436,494 | 4/1969 | Bozak | 179/115.5 |
| 3,780,232 | 12/1973 | Ward | 179/181 R |

FOREIGN PATENT DOCUMENTS

| | | | |
|---|---|---|---|
| 53-114679 | 10/1978 | Japan | 219/121 PD |
| 55-137798 | 10/1980 | Japan | 179/115 R |
| 1132574 | 11/1968 | United Kingdom | 219/121 EH |

*Primary Examiner*—A. D. Pellinen
*Assistant Examiner*—Danila R. Byrd
*Attorney, Agent, or Firm*—Charles L. Warren; Donald B. Southard; James W. Gillman

[57] ABSTRACT

An improved electrodynamic acoustic transducer with a slotted piston suspension system which results in greater linear excursions by relieving stresses within the diaphragm during the movement and allows improved operations of transducer with greater magnet size and greater radiating areas of diaphragm suspension. Overall efficiency of transducer is thereby improved. An improved piston suspension can be utilized with electrodynamic acoustic transducers operating in the range of 200 to 20,000 cycles per second.

14 Claims, 5 Drawing Figures

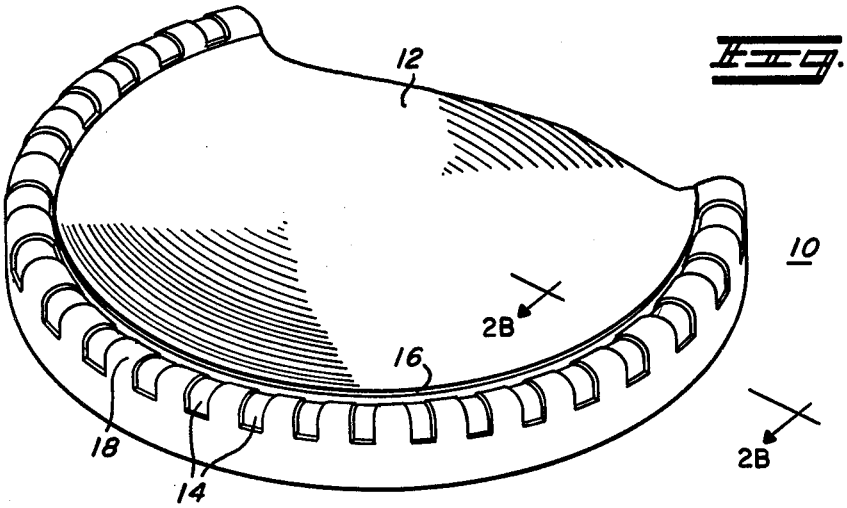
Fig. 2A
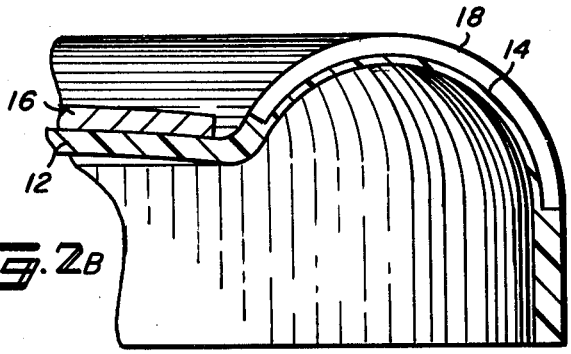
Fig. 2B
Fig. 3
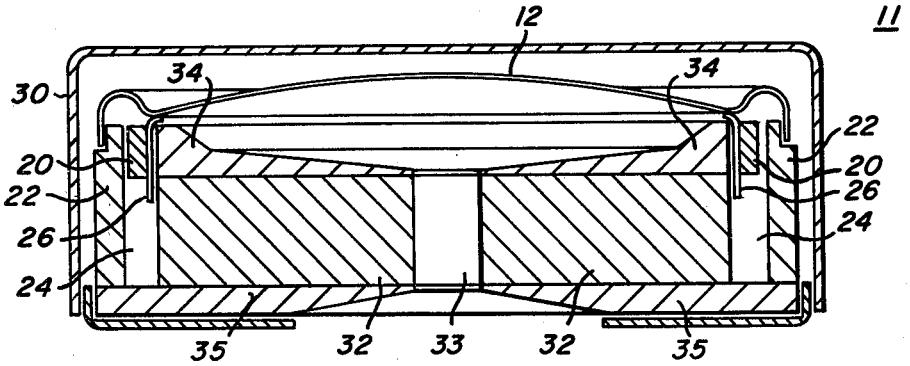

ACOUSTICAL TRANSDUCER WITH A SLOTTED PISTON SUSPENSION

BACKGROUND OF THE INVENTION

This invention relates to piston suspension assemblies for small electrodynamic acoustical transducers and particularly to those utilizing a single piece of resilient plastic material for the sound radiating dome and the piston suspension.

Piston suspension assemblies of many different shapes have been devised for use in cone displacement electrodynamic acoustical transducers containing permanent magnets to provide the electromagnetic fields required for operation. Small acoustical transducers are inexpensive and are typically found in portable two-way radio communications devices or personal electronic radio receiving apparatus.

To allow adequate expansion of the sound radiating dome, which will result in improved linear excursions during operation, small electrodynamic acoustic transducers require much larger piston suspensions than exist today. The piston suspensions found in the prior art are frought with many different types of stresses which occur at different positions within the plane of the sound radiating dome and piston suspension during cone displacement. One such stress is a "bending" stress which occurs along the circumference of the sound radiating dome at the junction of the piston suspension; a second stress is found stretching along a plane, perpendicular to the radii of the piston suspension, in the sound radiating dome. During operation, these types of stresses result in continued wear and tear of the piston suspension and sound radiating dome, thereby causing a decrease in the performance of the transducer in its ability to produce linear excursions during operation. This will result in the acoustical transducer becoming less and less effective as operation continues over a period of time.

The piston suspensions which are common in the prior art utilize arcuate slots contained within a flat (not curved) piston suspension. Generally, these slots, while relieving some of the stresses discussed above, create "bending" type stresses elsewhere in the piston suspension (i.e. in the material between the slots) and concentric "stretching" type stresses within the arcuate slots of the flat suspensions, which occur by the twisting motion of the sound radiating dome or cone during its displacement.

The prior art also illustrates that the piston suspensions of acoustical transducers are generally made from any varied materials and from a material different from that which the sound radiating dome is made. The resiliency of such materials is varied, which affects the linearity of the resulting excursions. This difference in material will introduce an additional cost in the manufacturing of the end product.

The prior art also illustrates that the sound radiating dome of an acoustical transducer is smaller in size for a given linear excursion, than the sound radiating dome associated with the piston suspension of the present invention.

SUMMARY OF THE INVENTION

It is an object of the present invention to provide an improved piston suspension assembly for an electrodynamic acoustical transducer which will result in increased efficiency and improved audio quality.

It is a further object of the invention to have an acoustical transducer piston suspension assembly produce linear excursions corresponding to much larger piston suspension assemblies which exist in larger electrodynamic transducers, thus allowing the surface area of the sound radiating dome and the size of the magnet to be increased, which will improve the efficiency of the transducer.

A still further object of the present invention is to provide a piston suspension assembly for a small acoustical transducer which has a center sound radiating dome of which at least 80% of the total surface area of the suspension and dome thereby allowing the use of magnets which are physically larger in size than those presently used in the same-sized electrodynamic transducers.

Yet another object of the present invention is to provide an electrodynamic transducer which has a piston suspension assembly made of a resilient plastic film to allow the surface area of the piston suspension to be sharply curved.

A still further object of this invention is to provide a sound radiating dome and piston suspension assembly which has been fabricated from a unified piece of resilient plastic film, which simplifies production and reduces costs.

In the preferred embodiment, a small electrodynamic acoustical transducer manufactured in accordance with the present invention comprises a piston suspension assembly which is sharply curved around the circumference of the center-positioned sound radiating dome and has elongated stress relieving slots integral to the surface thereof, such piston suspension being made from a resilient, flexible plastic film. The present invention will allow an increase in the size of the over-all piston suspension, which will result in a proportional increase in the linear excursions of the sound radiating dome, thereby increasing the overall performance of the transducer during operation. Alternatively, for the same required excursion produced by existing electrodynamic acoustical transducers in the prior art, the piston suspension of the present invention can be made smaller in size. In this manner, the radiating area and magnet size of the electrodynamic transducer can be maximized which will improve the operating efficiency of the transducer.

In practicing the invention, an improved unified piston suspension assembly is provided for use with an associated electrodynamic acoustical transducer. The piston suspension assembly includes a curved centered sound radiating dome and a curved piston suspension manufactured from the same single piece of resilient flexible plastic material. Similar materials, which can be sharply curved, may also be used. The curved piston suspension further includes stress-relieving elongated slots integral therein, said slots being positioned at predetermined intervals along the circumference of the upper surface of the piston suspension. The elongated slots have a predetermined reduced thickness relative to the thickness of the material of the surrounding piston suspension; this prevents air which is activated in front of the sound radiating dome from moving to the back sonic area which would normally result in sound cancellation. During operation of the associated electrodynamic acoustical transducer, the improved piston suspension assembly causes the simultaneous relief of certain bending stresses experienced along the radii of the sound radiating dome, as well as certain perpendicular concentric stresses, in such a manner as to enhance the overall effectiveness and the overall efficiency of the transducer.

The improved piston suspension is designed for use in the range of 200 to 20,000 cycles per second, and has been tested and found to be highly satisfactory in use.

BRIEF DESCRIPTION OF THE DRAWINGS

The invention will be more fully understood from the following description of the preferred embodiment of the improved piston suspension for an electrodynamic small acoustical transducer which is given by way of example and with reference to the accompanying drawings, in which:

FIG. 2A is a partial view in perspective of an improved piston suspension in accordance with the present invention useful for application in small acoustical electrodynamic transducers.

FIG. 2B is an enlarged partial cross-sectional view along lines 2*b* of FIG. 2A.

FIG. 3 is a cross-sectional view of a small electrodynamic acoustical transducer which incorporates the improved piston suspension of FIG. 2A.

DETAILED DESCRIPTION OF THE PREFERRED EMBODIMENT

Figure 1A:
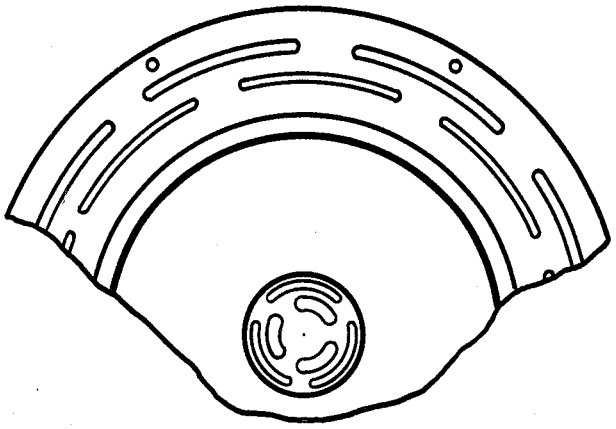
FIG. 1A PRIOR ART
FIG. 1A is a partial planar view of a piston suspension found in prior art devices.

The piston suspensions for acoustical transducers customarily found in the prior art devices create a number of different types of stresses during their cone displacement. One such stress is the "bending" stress along the radii of the suspension. Another stress, which is created during operation, is a "stretching" stress which is perpendicular to the radii of the suspension in the plane of the sound radiating dome. Also, there will exist certain concentric stretching stresses in the strips between the slots. In the prior art, concentric arcuate slots in the plane of a flat cone, are introduced. See FIG. 1A. While these slots will relieve bending stresses along the radii of the piston suspension, they will create bending stresses in the strips between the slots and create other concentric stretching stresses when the sound radiating dome twists during resulting displacement. This twisting motion is nonlinear and undesirable. Certain devices in the prior art introduce triangular openings or slots in the cone, which are positioned close to the edges of the cone. This will act as a suspension during cone displacement.

Figure 1B:
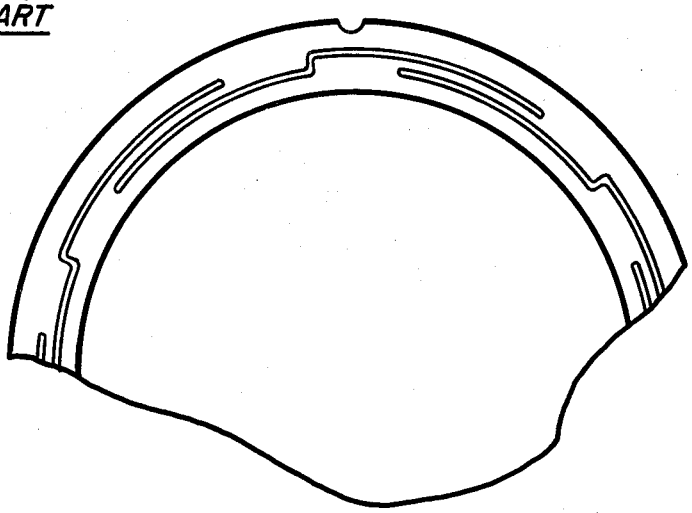
FIG. 1B PRIOR ART
FIG. 1B is a partial planar view of a piston suspension found in still other prior art devices.

When cone displacement of prior art acoustical transducers occur, there exists a strong buckling force which acts parallel to the surface of the cone and a weaker bending force which acts perpendicular to the surface of suspension. The strong buckling stresses and the weaker bending stresses are introduced along the radii of the piston suspension, and causes nonlinearity during operation and will result in a piston suspension which has a limitation of producing excursions which are small in the vertical dimension. See FIG. 1B.

Referring now to the drawings, FIG. 2A is a partial perspective view of the improved acoustical piston suspension 10 in accordance with the present invention, which illustrates the curvature of the resilient sound radiating dome 12 and the uniform recurring elongated stress relieving slots 14 in the outer circumference of the upper surface of the curved piston suspension. It is important to note that this piston suspension assembly is manufactured from a single piece of resilient plastic material or from materials of similar resiliency. In a preferred embodiment of the present invention, a reinforcing plastic film 16 may be permanently affixed to the sound radiating dome 12 to provide the necessary rigidity required for greater linear excursions in the radiating area and overall optimum effectiveness.

In this invention, the elongated stress-relieving slots 14, are specifically designed to relieve those stresses created which are perpendicular to the radii of the suspension (along the concentric circles). This will leave only the bending-type stresses remaining, which lie along the radii of the suspension in the material 18 between the slots 14.

FIG. 2B is an enlarged partial cross-sectional view through the stress relieving slot along lines 2*b* of FIG. 2A, contained within the improved piston suspension assembly. To enhance the resiliency and responsiveness of the piston suspension during operation, the reinforcing plastic film 16, does not interfere with the curved piston suspension, i.e. elongated stress-relieving slots 14 and the resilient material 18 between the elongated slots. It should be noted from this cross-section view, that a single piece of resilient plastic material is utilized to make the curved sound radiating dome and the curved piston suspension structure in the improved acoustical transducer.

The residual material within the elongated stress-relieving slots 14, which are incorporated in the outer circumference of the upper surface of the piston suspension, will prevent the activated air from moving from the front of the diaphragm to the rear of the sonic area which would result in sound cancellation. This material within the elongated stress-relieving slots have a predetermined thickness which is less than the thickness of the surrounding material of the curved piston suspension assembly. These slots are preferably made by a plasma etching or an ion milling process. All acoustical transducers which utilizes the present invention can be much smaller and still produce the same linear excursion. The unique piston suspension of the present invention maximizes the size of the associated electromagnet source and will allow the size of the magnet to be increased 80–100%, when compared to existing magnets of the same size transducer.

In FIG. 3, a cross sectional view of a small electrodynamic acoustical transducer 11, which incorporates the improved curved piston suspension, is represented. For purposes of this view, the transducer is contained within a housing 30. Construction of the precise electromagnetic circuit and the exact housing means for operation of the improved acoustical transducer is not essential for the present invention and are known to those skilled in the art. One such magnetic structure contains a permanent magnet in the shape of a disc structure 32, with a central cavity 33, a pole plate 34, and a second pole plate 35, made from soft magnetic material. The permanent magnet and the associated pole plates are enclosed in a cuplike structure 22, which is also made from soft magnetic material. In the disc structure 32, there exists an air gap 24, wherein a coil 20 is located, and where magnetic flux (not shown), which is created by the permanent magnet, is concentrated. The magnets provide flux through the pole plates and the air gap 24. The magnet pole plates, the magnetic flux and the cuplike structure complete the magnetic circuit. The coil 20 is wound on a bobbin 26 which is attached to the sound radiating dome, the suspension of which is secured to the cuplike structure. In this manner the coil 20 is resiliently held in a central position in the air gap 24. The housing 30 protects the improved acoustical transducer from external forces.

Thus, there has been provided according to the invention, an improved acoustical transducer with a slotted piston suspension which will facilitate an increase in the performance of the transducer during operation by increasing the resulting linear excursions of the sound radiating dome. Although the foregoing has been a description and illustrative of specific embodiment of the invention, various modifications and changes thereto can be made by persons skilled in the art within the scope and spirit of the invention as defined by the following claims.

What is claimed is:

1. An improved unified piston suspension assembly for utilization of an electrodynamic acoustical transducer, the piston suspension assembly comprising in combination:

a curved center sound radiating dome;

a curved piston suspension of resilient plastic material, the suspension formed from the same piece of resilient material as the curved centered sound radiating dome;

said curved piston suspension having stress-relieving elongated slots integral therein, each of said stress-relieving slots having a predetermined reduced thickness relative to the thickness of the surrounding piston suspension and being positioned at predetermined intervals along the circumference of said piston suspension, said suspension defining means for relieving certain bending stresses experienced along the radii of the curved sound radiating dome and certain perpendicular concentric stresses during the operation of the associated electrodynamic acoustical transducer.

2. An improved unified piston suspension assembly in accordance with claim 1, wherein a top sheet of resilient reinforcing plastic material of a predetermined thickness is contiguously affixed to the top surface of the centered sound radiating dome.

3. An improved unified piston assembly in accordance with claim 1, wherein the curved centered sound radiating dome has an effective radiating area of at least 80% of the total surface area of the suspension and dome.

4. An improved unified piston suspension assembly in accordance with claim 1 wherein the stress-relieving elongated slots are disposed solely upon said curved suspension and do not engage said dome.

5. An improved unified piston suspension assembly in accordance with claim 1 wherein said curved suspension comprises a single annular convex rim.

6. An improved unified piston suspension assembly in accordance with claim 1 wherein said slots comprises recesses formed by the removal of material from said suspension.

7. An improved unified piston suspension assembly in accordance with claim 6 wherein said elongated slots are spaced-apart and extend radially relative to the center of said dome.

8. An improved electrodynamic acoustical transducer assembly, including in combination:

a curved centered sound radiating dome;

an associated curved unified piston suspension of a resilient plastic material, the suspension being formed from the same piece of resilient material as the curved centered sound radiating dome;

said curved piston suspension having stress-relieving elongated slots integral therein, each of said stress-relieving slots having a predetermined reduced thickness relative to the thickness of the surrounding piston suspension and being positioned at predetermined intervals along the circumference of said piston suspension, a housing means to accommodate the transducer assembly;

and an associated electromagnetic circuit properly connected so as to operate the transducer assembly, said suspension defining means for relieving certain bending stresses experienced along the radii of the curved sound radiating dome and certain perpendicular concentric stresses, during the operation of the associated electrodynamic acoustical transducer.

9. An improved electrodynamic acoustical transducer assembly in accordance with claim 8, wherein a top sheet of resilient reinforcing plastic material of a predetermined thickness is contiguously affixed to the top surface of the centered sound radiating dome.

10. An improved electrodynamic acoustical transducer assembly in accordance with claim 8 wherein the curved centered sound radiating dome has an effective radiating area of at least 80% of the total surface area of the suspension and dome.

11. An improved unified piston suspension assembly for utilization with an electrodynamic acoustical transducer, the piston suspension assembly comprising in combination:

a sound radiating member;

a curved piston suspension of resilient plastic material, the suspension formed from the same piece of resilient material as the sound radiating member;

said curved piston suspension having stress-relieving elongated radial slots integral therein, each of said stress-relieving slots having a predetermined reduced thickness relative to the thickness of the surrounding piston suspension and being positioned at predetermined intervals along the circumference of said piston suspension, said suspension defining means for relieving certain bending stresses experienced along the radii of the sound radiating member and certain perpendicular concentric stresses during the operation of the associated electrodynamic acoustical transducer.

12. An improved unified piston suspension assembly in accordance with claim 11, wherein a top film of resilient reinforcing plastic material of a predetermined thickness is affixed to the top surface of the sound radiating member.

13. An improved electrodynamic acoustical transducer assembly, including in combination:

a sound radiating member;

an associated curved convex piston suspension of a resilient plastic material, the suspension being formed from the same piece of resilient material as the sound radiating member;

said curved piston suspension having stress-relieving elongated spaced-apart radial slots integral therein, each of said stress-relieving slots having a predetermined reduced thickness relative to the thickness of the surrounding piston suspension and being positioned at predetermined intervals along the circumference of said piston suspension, a housing means to accommodate the transducer assembly;

and an associated electromagnetic circuit properly connected so as to operate the transducer assembly, said suspension defining means for relieving certain bending stresses experienced along the radii of the sound radiating member and certain perpendicular concentric stresses during the operation of the associated electrodynamic acoustical transducer.

14. An improved piston suspension assembly in accordance with claim 13, wherein a top sheet of resilient reinforcing plastic material of a predetermined thickness is contiguously affixed to the top surface of the sound radiating member.

* * * * *